United States Patent [19]

Moreland

[11] Patent Number: 4,713,160

[45] Date of Patent: Dec. 15, 1987

[54] CURRENT LEAKAGE APPARATUS IN ELECTROLYTIC CELL

[75] Inventor: Peter J. Moreland, Frodsham, England

[73] Assignee: Imperial Chemical Industries PLC, London, England

[21] Appl. No.: 808,561

[22] Filed: Dec. 13, 1985

[30] Foreign Application Priority Data

Dec. 28, 1984 [GB] United Kingdom ..... 8432704

[51] Int. Cl.[4] ..... C25B 15/08; C25B 9/04

[52] U.S. Cl. ..... 204/231; 204/255; 204/257; 204/263

[58] Field of Search ..... 204/228, 231, 255, 257, 204/263–266, 279, 252–254, 256, 258, 128, 196, 290 R, 290 F, 292, 293

[56] References Cited

U.S. PATENT DOCUMENTS

| | | | |
|---|---|---|---|
| 1,764,650 | 6/1930 | Scott | 204/231 X |
| 2,762,767 | 9/1956 | Mosher et al. | 204/196 X |
| 2,890,157 | 6/1959 | Raetzsch | 204/128 X |
| 3,347,768 | 10/1967 | Clark et al. | 204/196 |
| 3,406,103 | 10/1968 | Raetzsch | 204/231 X |
| 3,477,930 | 11/1969 | Crites | 204/196 X |
| 3,972,796 | 8/1976 | Fröhler et al. | 204/279 X |
| 4,048,045 | 9/1977 | Eng et al. | 204/257 X |
| 4,057,473 | 11/1977 | Cunningham et al. | 204/128 X |
| 4,285,794 | 8/1981 | Bellows et al. | 204/260 |
| 4,375,400 | 3/1983 | Kircher | 204/257 X |
| 4,377,445 | 3/1983 | Grimes | 204/255 X |
| 4,465,579 | 8/1984 | Mataga | 204/255 |

FOREIGN PATENT DOCUMENTS

| | | |
|---|---|---|
| 53-061591 | 6/1978 | Japan . |
| 53-061592 | 6/1978 | Japan . |
| 1523045 | 8/1978 | United Kingdom . |
| 2085475 | 8/1981 | United Kingdom . |

*Primary Examiner*—Donald R. Valentine

*Attorney, Agent, or Firm*—Cushman, Darby & Cushman

[57] ABSTRACT

An electrolytic cell comprising at least one anode and at least one cathode and pipework for charging liquor to the electrolytic cell and pipework for discharging liquor from the electrolytic cell, in which at least one of the pipeworks is made in part of an electrically non-conducting material and which also comprises an electrically conducting electrode material positioned in the pipework, e.g. a section of pipework made of a metallic electrode material, and in which the electrode material is electrically connected directly or indirectly to the anode or cathode by means of an electrical connection external of the electrolytic cell.

2 Claims, 1 Drawing Figure

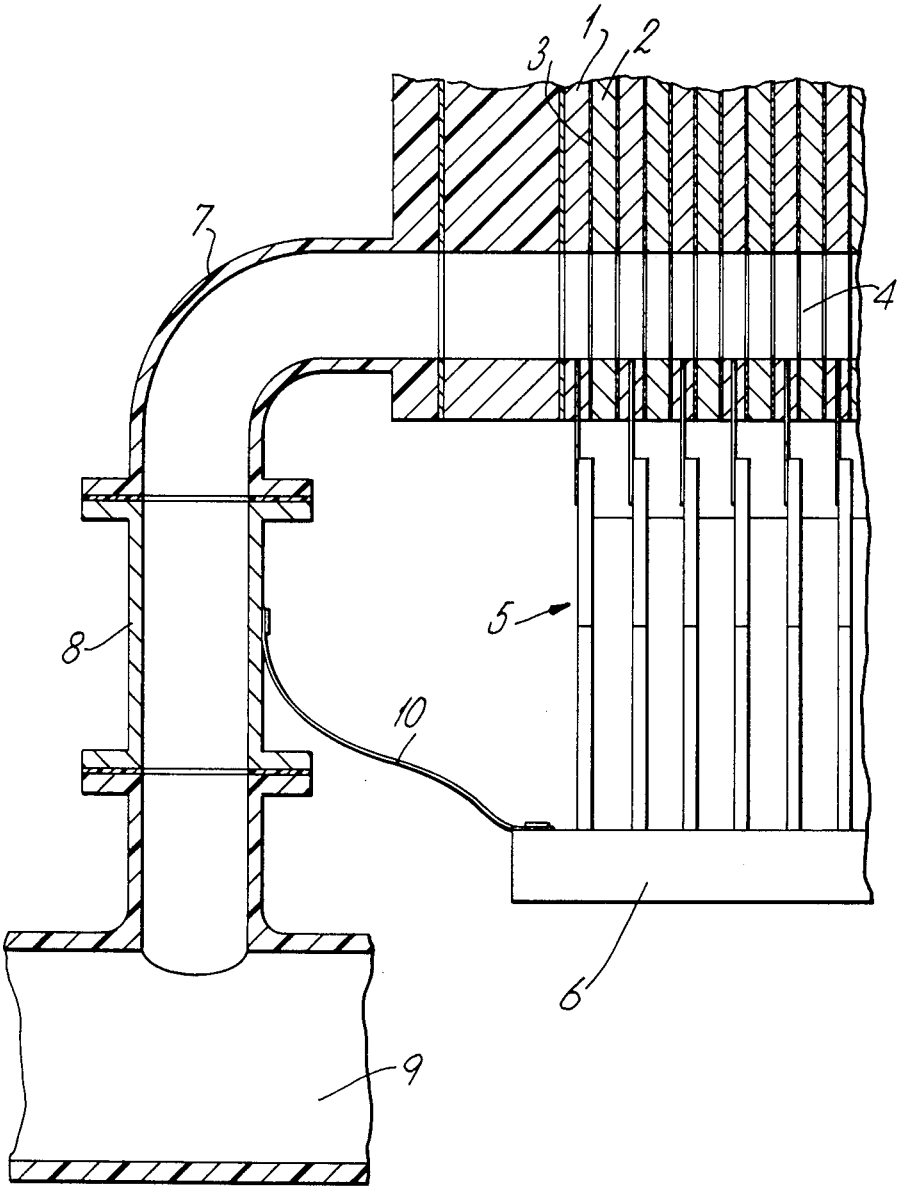
1
2
3
4
5
6
7
8
9
10

CURRENT LEAKAGE APPARATUS IN ELECTROLYTIC CELL

This invention relates to current leakage in an electrolytic cell and in particular to control of current leakage in order to minimise the corrosion in an electrolytic cell caused by such current leakage.

The production of chemical products by the electrolysis of solutions of ionisable chemical compounds, hereinafter generally referred to as electrolytes, is widely practised in industry.

For example, the electrolysis of an aqueous solution of an alkali metal halide to produce halogen and an aqueous solution of an alkali metal hydroxide or an aqueous solution of an alkali metal halate, e.g. by the electrolysis of an aqueous solution of sodium chloride, is practiced industrially on a vast scale.

Electrolytic cells for the production of chlorine and aqueous alkali metal hydroxide solution by the electrolysis of aqueous sodium chloride solutions generally are of three basic types, mercury cells, diaphragm cells, and membrane cells. In a mercury cell an aqueous sodium chloride solution is charged to a cell comprising a flowing mercury cathode and anodes which may be of graphite but which in modern practice are generally made of a film-forming metal, e.g. titanium, having an electro-conducting electro-catalytically active coating thereon, and sodium ions and chloride ions are liberated in the electrolysis, chlorine and a sodium amalgam being removed from the cell. Aqueous sodium hydroxide solution is produced by reacting the sodium amalgam with water in a so-called denuder and the depleted amalgam is returned to the electrolytic cell. A diaphragm cell comprises anodes and cathodes separated by hydraulically permeable diaphragms, for example, asbestos diaphragms, to form separate anode and cathode compartments, and the aqueous sodium chloride solution is charged to the anode compartments of the cell where it is electrolysed, chlorine is removed from the anode compartments, and an aqueous solution of sodium hydroxide containing sodium chloride is removed from the cathode compartments of the cell. A membrane cell comprises anodes and cathodes separated by hydraulically impermeable ion perm-selective membranes to form separate anode and cathode compartments, and the aqueous sodium chloride solution is charged to the anode compartments of the cell where it is electrolysed, chlorine is removed from the anode compartments, and an aqueous sodium hydroxide solution is removed from the cathode compartments of the cell. An electrolytic cell for the production of aqueous sodium chlorate solution does not comprise a diaphragm or membrane and the sodium hydroxide and chlorine produced by electrolysis are allowed to react in the electrolytic cell.

During use of electrolytic cells an electrolyte, for example aqueous sodium chloride solution, is charged from a reservoir of electrolyte at earth potential to the cell which is at a different electrical potential. The liquid products of electrolysis, for example, an aqueous solution containing sodium hydroxide or an aqueous solution containing sodium chlorate, are discharged from the cell to a reservoir at earth potential designed to receive the liquid products and there is a difference in electrical potential between the electrolytic cell and the product reservoir. Because of this difference in electrical potential there may be a leakage of current between the electrolytic cell and the reservoir from which the electrolyte is charged to the cell, and between the electrolytic cell and the reservoir to which the liquid products of electrolysis are discharged from the cell. The leakage of current occurs particularly where a continuous stream of electrolyte is charged to the electrolytic cell and/or where a continuous stream of the liquid products of electrolysis are discharged from the cell, the continuous streams providing a pathway for leakage of current. Whilst the leakage of current may not of itself be a particularly serious loss of electrical energy when compared with the overall electrical energy required to carry out the electrolysis it may lead to serious corrosion problems in the electrolytic cell. In particular it may lead to corrosion in those parts of the cell through which the electrolyte is charged to the cell and through which the liquid product of electrolysis is discharged from the cell, for example, at the metallic ports through which electrolyte or liquid product of electrolysis is charged to or from the electrode compartments of the cell, or at those parts of the electrodes adjacent to the ports. Furthermore, leakage of current may also be caused by differences in voltage to earth between electrolytic cells in a line of cells with the result that corrosion may occur, for example in pipework connecting such cells and through which liquor flows.

Leakage of current, which may be an anodic current or a cathodic current, and the associated corrosion problem, is particularly severe in an installation comprising a large number of individual electrolytic cells to which electrical current is supplied in series, for example in an installation comprising a large number of membrane or diaphragm cells arranged in series. In such an installation certain of the cells, and in particular those at or near the ends of the series, will be at a high potential relative to earth, that is at a high positive or negative potential depending on the position of a particular cell in the series. For example, in a diaphragm cell installation for the electrolysis of aqueous sodium chloride solution comprising 100 individual cells arranged in series there may be a potential difference of as much as 200 volts between the cells at or near the ends of the series and earth. Thus the leakage of current, and the associated corrosion problem, may be particularly severe in the electrolytic cells at or near the ends of such a series.

Various prior proposals have been made to decrease the extent of this current leakage and to reduce the extent of the associated corrosion problem.

For example, in Japanese patent publication No. 53061591 an electrolytic cell for the electrolysis of alkali metal chloride solution is described in which it is proposed to discharge the liquor from the cell in a discontinuous manner by forming the liquor into droplets in a device comprising a plurality of small diameter tubes or rods. In Japanese patent publication No. 53061592 it has been proposed to provide electrodes in a liquor discharging pipe in order to reduce the difference in electrical voltage at the outlet to less than 10 volts in order to suppress corrosion. In British Patent No. 1523045 it has been proposed to so choose the lengths and diameters of the electrolyte feed and discharge pipes as to limit the current leakage per cell to not more than 4% of the electrolysis current per cell.

In U.S. Pat. No. 4,048,045 there is described a target anode which is said to selectively control current leakage from an anode to an anolyte discharge manifold. The U.S. Patent describes an electrolytic cell having a passageway which connects an anode compartment and an anolyte discharge manifold, and positioned in the passageway an electrical conductor which connects the anode with the anolyte in the discharge manifold. The conductor, which is positioned within the passageway acts as a target anode and inhibits corrosion damage of the anode to which it is electrically connected.

The present invention provides an electrolytic cell comprising at least one anode and at least one cathode and pipework for charging liquor to said electrolytic cell and pipework for discharging liquor from said electrolytic cell, in which at least one of said pipeworks is made in part of an electrically non-conducting material and which also comprises an electrically conducting electrode material positioned in said pipework, and in which said electrode material is electrically connected directly or indirectly to said anode or cathode by means of an electrical connection external of the electrolytic cell.

The electrolytic cell may comprise a plurality of anodes and cathodes, and the electrolytic cell may have a separator positioned between each adjacent anode and cathode thus providing the electrolytic cell with a plurality of anode and cathode compartments. The separator may be a hydraulically permeable diaphragm or a substantially hydraulically impermeable ionically perm-selective membrane, e.g. a cation perm-selective membrane.

The electrolytic cell may be a monopolar or a bipolar electrolytic cell.

Where the electrolytic cell comprises a plurality of anode and cathode compartments it may also comprise a manifold or header provided with a plurality of branches which lead to, or from, the anode compartments of the cell, and a manifold or header provided with a plurality of branches which lead to, or from, the cathode compartments of the cell.

The pipework, which may lead to or from the manifold or header, or form part of the manifold or header, is made at least in part of an electrically non-conducting material and an electrode material is positioned in said pipework. For example, the electrode material may be in the form of a section of pipework made of an electrically conducting material, e.g. a metal. A section of pipework of electrically non-conducting material may be positioned between the electrolytic cell and a section of pipework made of an electrically conducting material. A section of pipework of electrically conducting material may be positioned between two sections of pipework made of an electrically non-conducting material.

The electrode material is electrically connected directly or indirectly to the anode or anodes, or to the cathode or cathodes, of the electrolytic cell by means of an electrical connection external of the electrolytic cell. For example, the electrical connection may be indirect by means of an electrically conducting lead attached to the electrode material in the pipework and, in the case of a monopolar electrolytic cell, to the bus-bar to which the anodes, or the cathodes, are themselves connected. In the case of a bipolar electrolytic cell the electrically conducting lead may be attached to the electrode material in the pipework and directly to the terminal anode, or terminal cathode of the electrolytic cell.

As the aforementioned electrical connection is external of the electrolytic cell and is not for example within the pipework of the cell, it provides a number of significant technical advantages. Thus the electrical connection is readily made and secured, failure of the connection may readily be noted and repaired, electrical connection may readily be made to a meter for determining the direction and magnitude of leakage current, and the electrically conducting part in the pipework and the associated electrical connection may readily be installed with at most only minimum modification of the electrolytic cell being required. The ability to monitor the direction of the leakage current aids in the choice of the materials of construction, for example of electrode materials. For example, titanium might be unsuitable where there is a cathodic leakage current as such a leakage current may cause embrittlement of titanium.

In operation leakage currents are discharged at the electrode material, for example on the electrically conducting parts of the pipework, rather than at the parts leading to or from the anode or cathode compartments of the cell, or on those parts of the anodes or cathodes adjacent thereto. The invention provides for discharge of leakage currents in a controlled manner thus reducing or even eliminating uncontrolled corrosion caused by such leakage currents.

The nature of the electrode material will depend on the nature of the electrolyte. The electrode material may suitably be the same as that of the anodes or cathodes of the electrolytic cell to which it is electrically connected.

Where aqueous alkali metal chloride solution is to be electrolysed the anode is suitably made of a film-forming metal or an alloy thereof, for example of zirconium, niobium, tungsten or tantalum, but preferably of titanium, and the operative surfaces of the anode suitably carry a coating of an electro-conducting electrocatalytically-active material. The coating may comprise one or more platinum group metals, that is platinum, rhodium, iridium, ruthenium, osmium or palladium, and/or an oxide of one or more of these metals. The coating of platinum group metal and/or oxide may be present in admixture with or in the form of a solid solution with one or more non-noble metal oxides, particularly one or more film-forming metal oxides, e.g. titanium dioxide. Electro-conducting electro-catalytically-active materials for use as anode coatings in an electrolytic cell for the electrolysis of aqueous alkali metal chloride solution, and methods of application of such coatings, are well known in the art. The coating is suitably applied at least to those faces of the anode which in the electrolytic cell face the cathode.

The electrode material, for example, the electrically conducting part of the pipework, suitably comprises a substrate of a film-forming metal or alloy thereof and a coating of an electro-conducting electrocatalytically-active material as described.

Where aqueous alkali metal chloride solution is to be electrolysed the cathode is suitably made of iron or steel, or of other suitable metal, for example nickel or nickel alloy, particularly where the cathode is to be installed in a membrane cell. The operative surfaces of the cathode may be treated, e.g. by roughening the surfaces and/or by coating the surfaces with a suitable material, e.g. a platinum group metal and/or oxide thereof, in order to reduce the hydrogen overvoltage at the cathode.

The electrode material, for example the electrically conducting part of the pipework, suitably is of the same composition as the cathode itself. For example, it may be of nickel or nickel alloy.

Where the separator, if any, to be used in the electrolytic cell is a hydraulically permeable diaphragm the nature of the diaphragm will depend on the nature of the electrolyte which is to be electrolysed in the cell. The diaphragm should be resistant to degradation by the electrolyte and by the products of electrolysis and, where an aqueous solution of alkali metal chloride is to be electrolysed, the diaphragm is suitably made of asbestos or of an organic polymeric material which is resistant to degradation, for example, a fluorine-containing polymeric material, as such materials are generally resistant to degradation by the chlorine and alkali metal hydroxide produced in the electrolysis. Preferably, the diaphragm is made of polyetrafluoroethylene, although other materials which may be used include, for example, tetrafluoroethylenehexafluoropropylene copolymers, vinylidene fluoride polymers and copolymers, and fluorinated ethylenepropylene copolymers.

Suitable microporous diaphragms are those described, for example, in UK Pat. No. 1503915 in which there is described a microporous diaphragm of polytetrafluoroethylene having a microstructure of nodes interconnected by fibrils, and in UK Pat. No. 1081046 in which there is described a microporous diaphragm produced by extracting a particulate filler from a sheet of polytetrafluoroethylene. Other suitable microporous diaphragms are described in the art.

Where the separator, if any, to be used in the cell is an ion-exchange membrane the nature of the membrane will also depend on the nature of the electrolyte which is to be electrolysed in the cell. The membrane should be resistant to degradation by the electrolyte and by the products of electrolysis and, where an aqueous solution of alkali metal chloride is to be electrolysed, the membrane is suitably made of a fluorine-containing polymeric material containing cation-exchange groups, for example, sulphonic acid, carboxylic acid or phosphonic acid groups, or derivatives thereof, or a mixture of two or more such groups.

Suitable cation-exchange membranes are those described, for example, in UK Pat. Nos. 1184321, 1402920, 1406673, 1455070, 1497748, 1497749, 1518387 and 1531068.

In the electrolytic cell the individual anode compartments of the cell will be provided with means for feeding electrolyte to the compartments, suitably from a common header, and with means for removing products of electrolysis from the compartments. Similarly, the individual cathode compartments of the cell will be provided with means for removing products of electrolysis from the compartments, and optionally with means for feeding water or other fluid to the compartments, suitably from common headers.

The common headers may be formed by openings in the gaskets, and optionally in the anodes and cathodes of the electrolytic cell, which openings together form lengthwise channels which serves as headers. The means for feeding electrolyte to, and removing the products of electrolysis from, the anode and cathode compartments of the cell may be channels in the walls of the gaskets or of the anodes and cathodes which lead from the lengthwise channels to the anode and cathode compartments.

A specific embodiment of the invention is now described with the aid of the accompanying figure which shows a diagrammatic representation of a part of a monopolar electrolytic cell and associated pipework.

The electrolytic cell comprises a plurality of anodes 1 and cathodes 2 each anode 1 being separated from the adjacent cathode 2 by a cation-permeable ion-exchange membrane 3. The adjacent anodes and cathodes are electrically insulated from each other by means of gaskets (not shown).

The anodes 1, cathodes 2, and gaskets each contain an opening therein, which openings in combination form a channel 4 which runs lengthwise of the electrolytic cell and which serves as a header through which waste electrolyte is discharged from the anode compartments of the cell. The anodes 1, cathodes 2, and gaskets each comprise three other such openings, which are not shown, but which in the cell in combination form headers through which electrolyte may be charged to the anode compartments of the cell and through which fluid may be charged to and products of electrolysis may be removed from the cathode compartments of the cell.

The electrolytic cell also comprises copper members 5 attached to the anodes 1 of the cell, the copper members being in turn electrically connected to a bus-bar 6. Copper members attached to the cathodes 2 and to a bus-bar are not shown.

The channel 4 is connected to a flanged discharge pipe 7 of a non-metallic material, for example a glass-reinforced polyester resin. The pipe 7 is in turn connected to a flanged pipe insert 8 made of the same material as the anodes 1, and then to a discharge pipe 9 of a non-metallic material which leads to a reservoir (not shown) for waste electrolyte.

The flanged pipe insert 8 is connected electrically to the bus-bar 6 by means of an electrical connection 10 positioned externally of the electrolytic cell. The flanged pipe insert 8, and the anodes 1, may be made of titanium and may be coated with an electro-conducting electrocatalytically active material, for example, a mixture of or solid solution of $RuO_2$ and $TiO_2$, particularly where aqueous sodium chloride solution is to be electrolysed in the cell. The cathodes 2 may be of nickel or nickel alloy.

In operation, the bus-bar 6 and the associated anodes 1 are at a positive potential whereas the reservoir to which waste electrolyte is passed is at earth potential. Leakage current in the electrolyte passing through the pipe 7 is discharged on the flanged pipe insert 8, which, because of the electrical connection 10, is at the same potential as the bus-bar 6. If and when the flanged pipe insert 8 corrodes due to discharge of leakage current it may readily be replaced. The electrical connection 10 may comprise a meter for monitoring the direction of and the magnitude of the leakage current.

Monopolar electrolytic membrane cells of the type described each of which comprised 60 anodes and 60 cathodes separated by perfluoropolymer cation-exchange membranes were installed in a cell room which comprised 4 rows of cells as follows:

| | | |
|---|---|---|
| Row A | cells 1 to 5 | diaphragm cells |
| | cells 6 to 8 | membrane cells |
| | cell 9 | diaphragm cell, |
| Row B | cells 1 to 11 | diaphragm cells |
| Row C | cells 1 to 7 | diaphragm cells, |
| Row D | cells 1 to 3 | diaphragm cells |
| | cells 4 to 6 | membrane cells |
| | cell 7 | diaphragm cell. |

The cells were electrically connected in series with electrical connectors being positioned between the last cell in one row and the first cell in an adjacent row.

For the purposes of experiment the electrolyte feed to and product discharge from the diaphragm cells was separate from the electrolyte feed to and product discharge from the membrane cells.

Saturated aqueous sodium chloride solution was charged to the anode compartments of the three membrane cells of Row A through a common pipework, and water was charged to the cathode compartments of the three membrane cells of Row A through a common pipework. Products of electrolysis from the anode and cathode compartments of the cells, that is chlorine and depleted aqueous sodium chloride solution, and hydrogen and aqueous sodium hydroxide solution, respectively, were likewise discharged to common pipeworks. The three membrane cells of Row D comprised similar pipeworks separate from those of the cells of Row A. Each of the pipeworks through which depleted aqueous sodium chloride solution was discharged from the anode compartments and through which sodium hydroxide solution was discharged from the cathode compartments comprised a metallic part made of the same material as the anode or cathode, as the case may be, and being electrically connected through an ammeter to the anode or cathode bus-bar associated with each of the membrane cells.

Aqueous sodium chloride solution was electrolysed in the membrane cells in the manner hereinbefore described, the voltage to the cell room being of the order of +63 volts.

The voltages of the membrane cells were as follows:

| Cell | Voltage, volts |
|---|---|
| A6 | −45.5 |
| A7 | −42 |
| A8 | −38.5 |
| D4 | 52.5 |
| D5 | 49 |
| D6 | 45.5 |

| Cell | Leakage current amps |
|---|---|
| | Depleted aqueous sodium chloride solution |
| A6 | −0.25 |
| A7 | −0.23 |
| A8 | −0.22 |

-continued

| Cell | Leakage current amps |
|---|---|
| D4 | 0.29 |
| D5 | 0.27 |
| D6 | 0.25 |
| | Aqueous sodium hydroxide solution |
| A6 | −0.70 |
| A7 | −0.65 |
| A8 | −0.59 |
| D4 | 0.81 |
| D5 | 0.75 |
| D6 | 0.70 |

The membrane electrolytic cells were operated for 3 months and then dismantled.

There was no visible sign of corrosion on the anode or cathodes of the cells not at the exit ports from the cells.

I claim:

1. An electrolytic cell comprising at least one anode and at least one cathode and a separator positioned between each anode and adjacent cathode to form in the cell separate anode compartments and cathode compartments, and pipework for charging liquor to and/or for removing liquor from said anode compartments and pipework for charging liquor to and/or removing liquor from said cathode compartments, in which at least one of said pipeworks is made in part of an electrically non-conducting material and which also comprises an electrically conducting electrode material positioned in said pipework, and in which said electrode material is positioned in the pipework for charging liquor to and/-for removing liquor from said anode compartments and is connected directly or indirectly to said anode by means of an electrical connection external of the electrolytic cell.

2. An electrolytic cell comprising at least one anode and at least one cathode and a separator positioned between each anode and adjacent cathode to form in the cell separate anode compartments and cathode compartments, and pipework for charging liquor to and/or for removing liquor from said anode compartments and pipework for charging liquor to and/or removing liquor from said cathode compartments, in which at least one of said pipeworks is made in part of an electrically non-conducting material and which also comprises an electrically conducting electrode material positioned in said pipework and in which said electrode material is positioned in the pipework for charging liquor to and-/or for removing liquor from said cathode compartments and is connected directly or indirectly to said cathode by means of an electrical connection external of the electrolytic cell.

* * * * *